United States Patent [19]

Blankstein et al.

[11] Patent Number: 4,745,719

[45] Date of Patent: May 24, 1988

[54] HOUSING STRUCTURE

[76] Inventors: Murray E. Blankstein, 145 Sheldrake Boulevard, Toronto, Ontario, Canada, M4P 2B1; Hershel B. Okun, 195 Strathgowan Avenue, Toronto, Ontario, Canada, M4N 1C4

[21] Appl. No.: 363,675

[22] Filed: Mar. 30, 1982

[51] Int. Cl.[4] ..... E04H 1/04

[52] U.S. Cl. ..... 52/234; 52/79.1; 52/79.2; 52/79.8; 52/173 R; 52/236.3

[58] Field of Search ..... 52/236.2, 236.3, 234, 52/79.2, 173, 741, 220, 238, 169, 79.1, 79.3, 79.8, 79.7

[56] References Cited

U.S. PATENT DOCUMENTS

| | | | |
|---|---|---|---|
| 2,154,142 | 4/1939 | Whelan | 52/79.3 |
| 2,168,725 | 8/1939 | Whelan | 52/236.3 |
| 3,552,075 | 1/1971 | Crump | 52/236.3 |
| 3,768,221 | 10/1973 | Fuller . | |
| 3,852,924 | 12/1974 | Levenson | 52/173 |

OTHER PUBLICATIONS

Architectural Record, May 1939, p. 89, Sci. Lib. Call No. NA 1 A66.

*Primary Examiner*—James L. Ridgill, Jr.
*Attorney, Agent, or Firm*—Rogers, Bereskin & Parr

[57] ABSTRACT

The disclosure relates to a house which has the external appearance of a conventional bungalow but which can be converted between a single family home and a two family home. The house has two living units including respective living areas which are disposed side by side and separated by a demising wall. The living areas include kitchens disposed in contiguous relationship on opposite sides of the wall and the wall includes a section between the kitchens which is closed when a two family home is required but which can be opened to permit access between the kitchens when the structure is to serve as a single family home. The kitchens then combine into a single enlarged kitchen and provide access between the two living units.

6 Claims, 5 Drawing Sheets

HOUSING STRUCTURE

This invention relates to a housing structure convertible between a single family home and a two family home.

Increasing housing costs have resulted in a situation in which the cost of a traditional single family home is beyond the resources of many first time buyers. As a result, it is not uncommon for a purchaser to initially rent out one or more rooms in a house to assist in financing the purchase of the house. Often, the intention is that the tenant will leave when the purchaser's financial situation reaches a stage at which he or she can carry the cost of of house alone. However, a problem with such an arrangement is that conventional houses are not constructed for ready conversion between single family and multiple family occupancy. As a result, significant expense may be involved in converting a conventional house.

Proposals have been made to provide houses which are specially designed for conversion between single and multiple family configurations. By way of example, U.S. Pat. No. 3,852,924 (Levenson) discloses a housing assembly with convertible housing units. In that case, modular housing units are arranged side by side with a common wall and may be selectively constructed as two-bedroom units or as one one-bedroom unit and one three-bedroom unit. U.S. Pat. No. 3,552,075 (Crump) discloses a dwelling unit specifically designed for conversion between a single family home and and two family home.

A problem with prior art convertible housing structures is that they are usually designed so that rooms are simply added or subtracted when the structure is converted; generally, the size of living spaces such as the kitchen does not actually change. For example, a structure designed to accommodate two families must have two kitchens, but when the structure is converted for single family occupation neither kitchen grows in size but the structure simply retains two kitchens, each of which is disproportionately small compared to the overall size of the "expanded" space available for single family occupation and thus cannot readily accommodate an increased number of occupants.

An object of the present invention is to provide an improved housing structure convertible between a single family home and a two family home.

According to the invention, the structure defines two living units, each of which has a separate entrance and is capable of accommodating a family living separately from a family in the other unit. The living units include respective living areas which are disposed side by side and separated by a demising wall. The living areas include respective kitchens disposed in contiguous relationship on opposite sides of the wall and the wall includes at least one section between the kitchens which is closed when the structure is to serve as a two family home but which can be opened to permit access between the two kitchens when the structure is to serve as a single family home. The kitchens and wall section are designed to permit the kitchens to combine into a single enlarged kitchen and provide access between the two living units when the section is opened.

It will be appreciated that the kitchen area of the structure will effectively "grow" when the structure is converted from a two family home to a single family home, with the intention that the enlarged kitchen will match the space available to the occupants of the structure. Conversely, if the structure is used for two family occupancy, each family has available to it a kitchen of the appropriate size.

Other sections of the demising wall may be arranged to be opened to expand the effective living area on conversion for single family occupancy. For example, contiguous living and dining room areas could also be provided in respective living units and separated by one or more of said wall sections.

A housing structure of the form provided by the invention is preferably designed to have the external appearance of a conventional house. Since no external changes are required to convert between single family and two family occupation, it is believed that such a structure would be particularly attractive to people who would otherwise ordinarily wish to purchase conventional houses. The house can be purchased ready for occupation by two families with a second (tenant) family contributing to the carrying costs of the house. When the purchaser requires more space and the tenant leaves, the house can be converted for single family occupation without any change in the appearance or the structure of the house. Conversely, the house could be purchased ready for single family occupation and then converted for two family occupation when less space is required, e.g. as children grow up and leave.

In order that the invention may be more clearly understood, reference will now be made to the accompanying drawings which illustrate a preferred embodiment of the invention by way of example. In the drawings.

Figure 1:
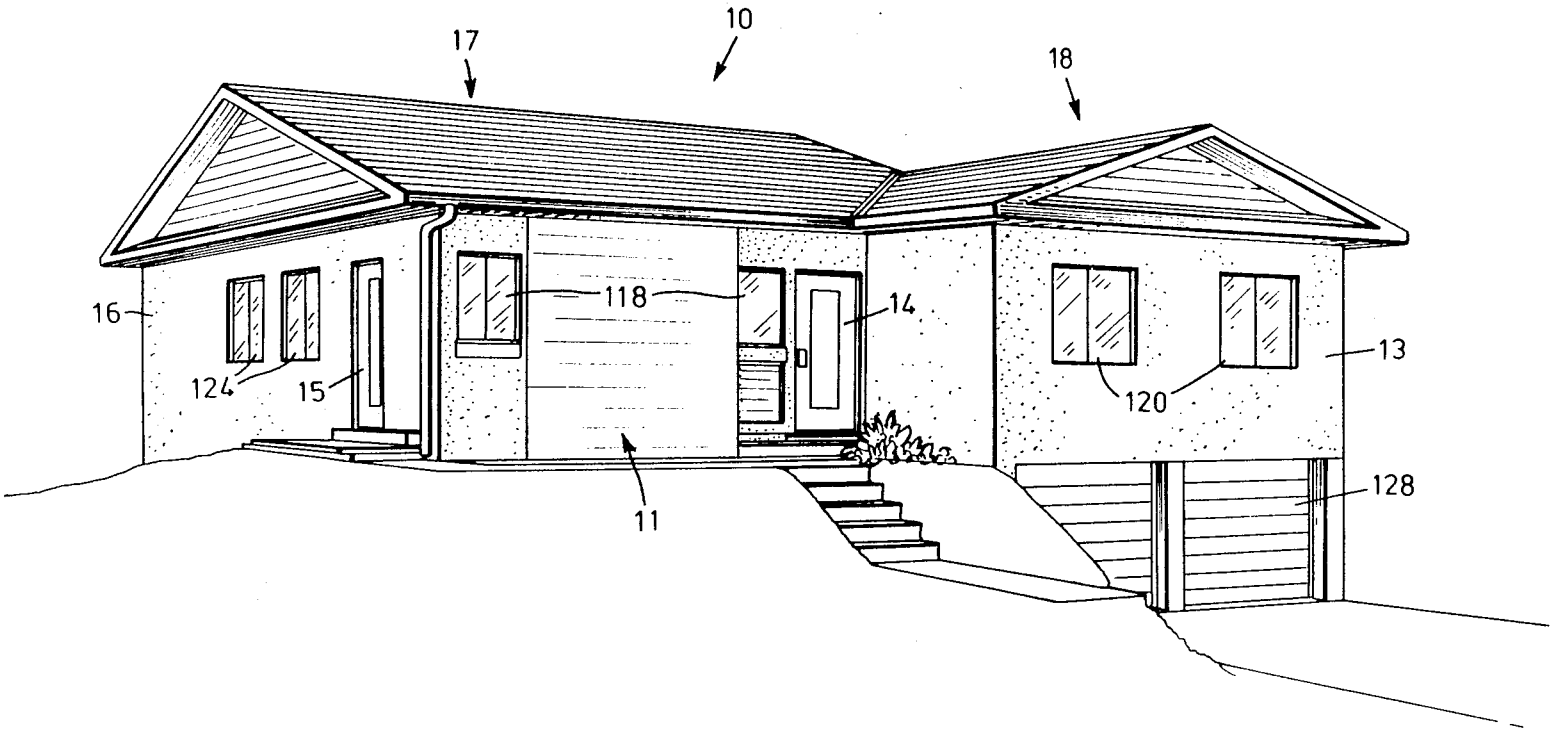
FIG. 1 is a perspective view from the front of a housing structure according to the invention.

Referring first to FIG. 1, the housing structure is indicated generally at 10, and is shown slightly raised out of the ground. It will be seen that the structure is designed to have the external appearance of a conventional raised bungalow. The structure has a front boundary wall 11 which is set-back at 12 from a front end portion 13, and provided with a first entrance 14 having the appearance of a conventional front door. A second entrance 15 is provided in a side boundary wall 16 and has the appearance of a conventional side door. Two roof structures 17 and 18 are provided and are disposed mutually at right angles.

Figure 2:
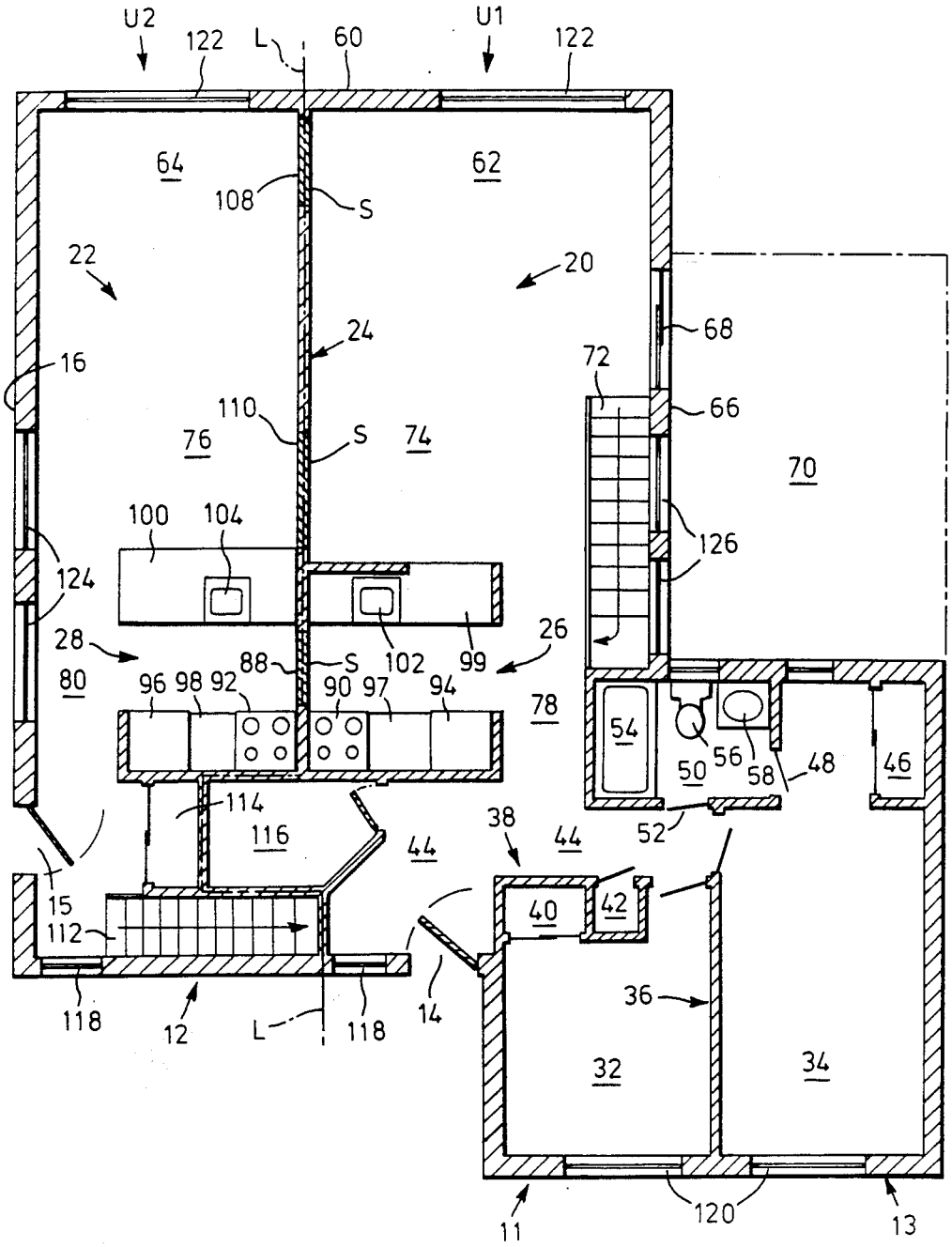
FIG. 2 is a plan view of the upper floor of the structure of FIG. 1 arranged as a two family home.
Figure 3:
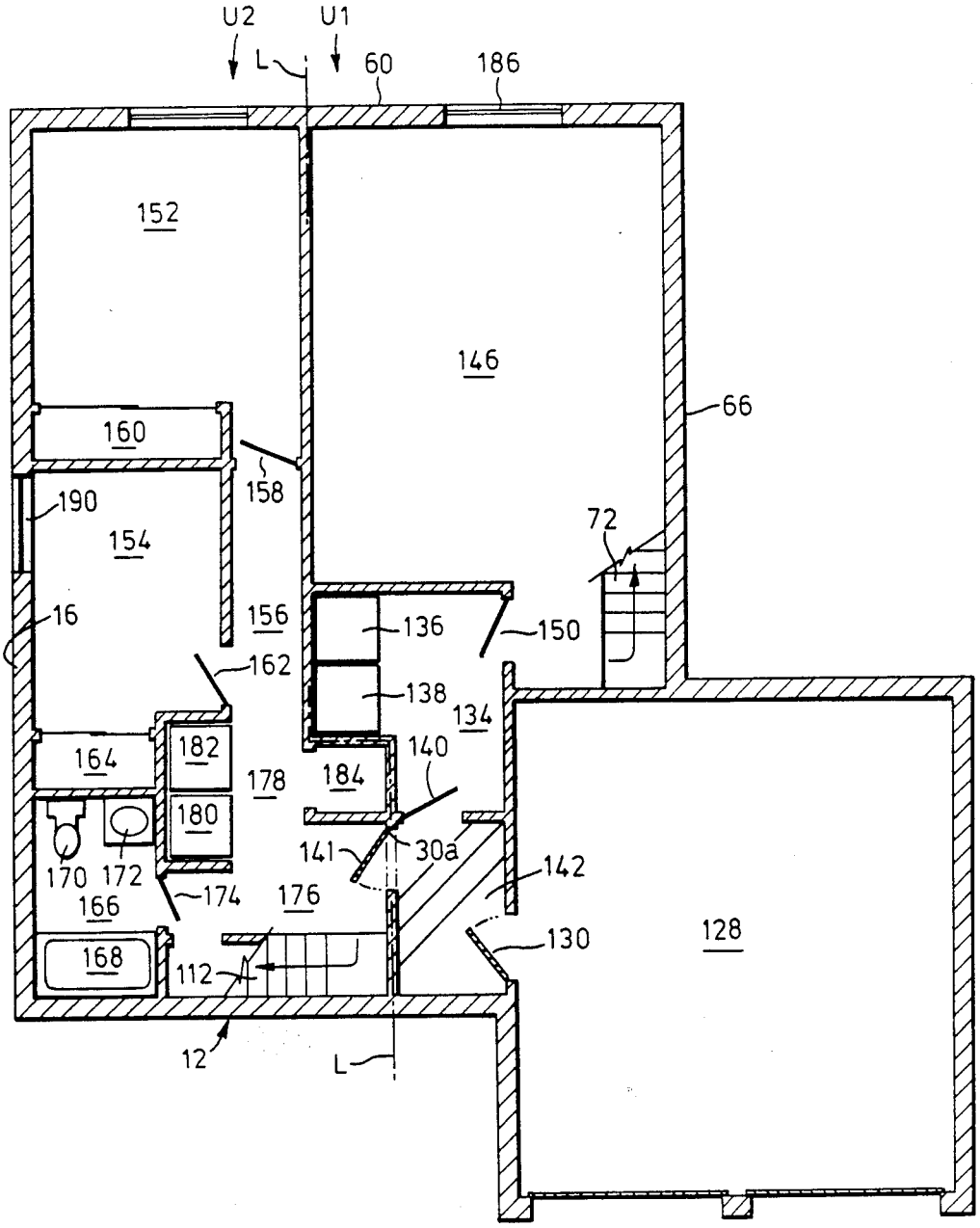
FIG. 3 is a plan view of the lower floor level of the structure of FIG. 1.
Figure 4:
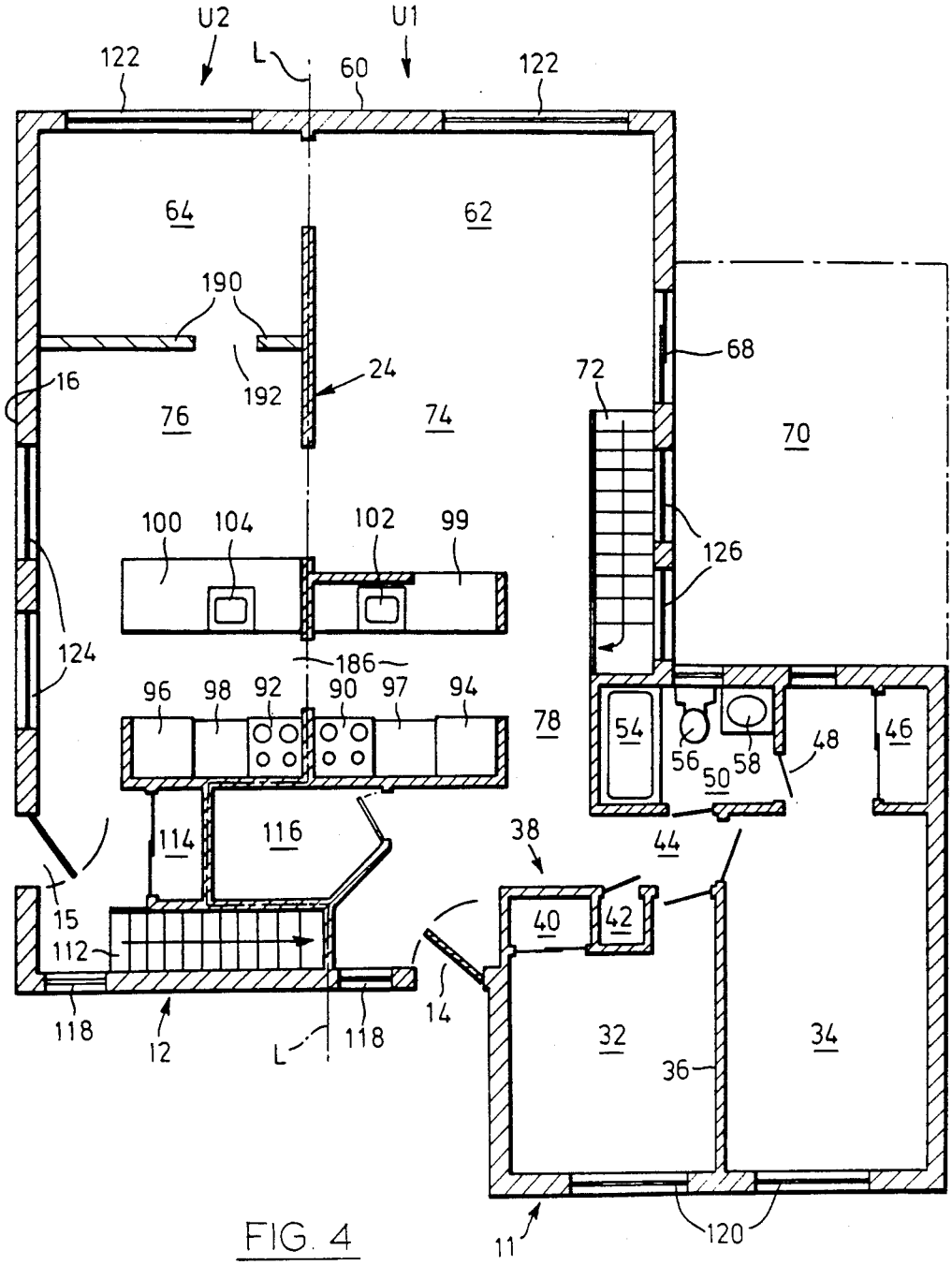
FIG. 4 is a view similar to FIG. 2, but showing the structure as converted to a single family home.
Figure 5:
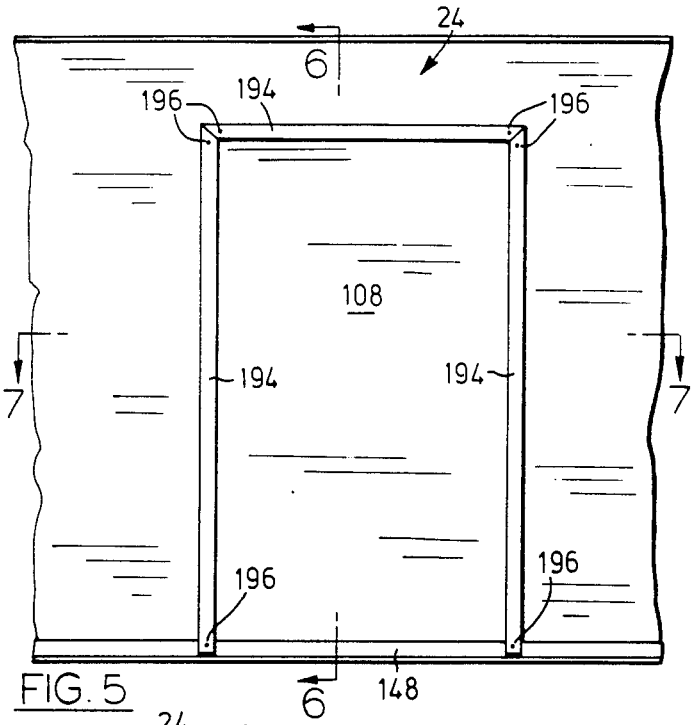
FIG. 5 is a front elevational view of a removable prefabricated wall panel used in the demising wall of the housing structure shown in the previous views.

Referring now to FIGS. 2, 3 and 4, the housing structure is vertically divided to define two living units denoted U1 and U2. Thus, each units has rooms both on the ground floor level (FIGS. 2 and 4) and on the basement level (FIG.3). The boundary between the two units is indicated by a chain-dotted line denoted L. Unit U1 is accessible from the front entrance 14 to the structure (FIG. 1) while unit U2 is accessible from the side entrance 15.

Each unit is capable of accommodating a family living separately from the family in the other unit and has a living area including a living room, dining room and kitchen, two bedrooms, a bathroom and laundry and storage facilities. In addition, both units have access to a garage through a common vestibule. Unit U1 also has a recreation room. The specific arrangement of the rooms will be described in detail later. In the meantime, referring specifically to FIG. 2, the two units U1 and U2 include respective living areas generally denoted 20 and 22 respectively at ground floor level separated by a demising wall generally denoted 24. In this embodiment, each living area includes a living room, dining room and kitchen. The two kitchens are generally denoted 26 and 28 and are disposed in contiguous relationship on opposite sides of the demising wall. The wall includes a section denoted S between the kitchens which is closed as shown in FIG. 2 when the housing structure is to serve as a two family home but which can be opened to permit access between the two kitchens when the structure is to serve as a single family home as shown in FIG. 4. The kitchens and wall section S are designed so that the kitchens combine into a single enlarged kitchen and provide access between the two living units when the section is open.

In this particular embodiment, demising wall 24 also includes two further removable sections, also denoted S, and disposed between the respective living rooms and dining rooms for the two units. These sections can also be open so that the two living room areas and dining room areas also in effect combine when the structure is to be used as a single family home; in this way, the whole living area in effect "expands", which is in contrast to the simple addition of rooms as in prior art housing structures.

The lower floor (basement) level shown in FIG. 3 also includes a demising wall, denoted 30, between the two living units. In this case, the wall has a single opening, denoted 30*a* which provides access from Unit U2 to the garage of the structure as will be described, so that the garage is accessible from both units.

Reference will now be made primarily to FIGS. 2, 3 and 4 in more detail in specifically describing the arrangement of rooms and other facilities within the housing structure.

As seen in FIG. 2, unit U1 includes two bedrooms denoted 32 and 34 disposed inside the portion 13 of the front boundary wall of the structure and separated by a common wall 36. At the rear of the bedroom 32, an enclosure 38 is subdivided into a closet 40 accessible from within bedroom 32, and a linen closet 42 accessible from an access corridor 44 leading to both bedrooms. Bedroom 34 is the larger of the two and is intended to serve as a master bedroom and is provided with a closet 46 in the rear outer corner, and with an entrance 48 to a bathroom 50 located immediately to the rear of corridor 44. Bathroom 50 has a second entrance 52 from corridor 44, and is provided with a bathtub 54, a toilet 56 and a sink 58.

The structure has a rear boundary wall 60, inside which are located living rooms 62, 64 of the two units U1, U2 respectively. An outside entrance 68 to living room 62 from an external patio 70 is provided in a side boundary wall 66 of the structure. Adjacent entrance 68, a staircase 72 provides access to the lower floor level of unit U1. The living areas 20, 22 of the respective units U1, U2 also include respective dining areas 74, 76 and access corridors 78, 80 located adjacent staircase 72 and side boundary wall 16 respectively.

Immediately forward of the dining areas 74, 76, and inward of corridors 78, 80, are the kitchens 26, 28. As indicated previously, the kitchens are separated by a section S of demising wall 24; in this embodiment, section S takes the form of a removable, generally rectangular, prefabricated wall panel 88. The front areas of the kitchens are provided with stoves 90, 92 and refrigerators 94, 96 with intervening counters 97, 98. Counters 99, 100 having sinks 102, 104 respectively, are provided in rear areas of the kitchens.

Wall 24 also includes further wall panels 108, 110 similar to panel 88 and disposed respectively between the living rooms 62, 64 and the dining areas 74, 76. The form of these panels will be described in detail later.

Adjacent and inside the set-back portion 12 of front boundary wall 11, a staircase 112 connects upper and lower floor levels of living unit U2. A clothes closet 114 is provided in unit U2 directly opposite entrance 15 and immediately to the rear of staircase 112. Adjacent entrance 14 and accessed by corridor 44, is a walk-in closet 116.

The set-back portion 12 and the remaining portion of front boundary wall 11, rear boundary wall 60, and opposite side boundary walls 16, 66 are respectively provided with windows 118, 120, 122, 124, 126.

Referring now to FIG. 3, a double garage 128 is provided immediately below the bedrooms 32, 34, bathroom 50, corridor 44 and part of corridor 78 of the upper floor. Garage 128 has an interior doorway 130 leading to a vestibule 142 which provides access to both units U1 and U2 through respective lockable doors 140 and 141. The two doors have different locks which can be opened only by the occupants of the respective units.

The door 140 from vestibule 142 into unit U1 leads into a laundry room 134 which has a washing maching 136 and a dryer 138. A further doorway 150 provides access from laundry room 134 into a recreation room 146 to which access is available from the upper level by staircase 72.

On the lower level, living unit U2 has a master bedroom 152, a second bedroom 154, and an access corridor 156. Corridor 156 extends through a doorway 158 into the master bedroom 152, which is located at the rear corner of housing structure 10. The forwardmost portion 160 of master bedroom 152, adjacent corridor 156, is provided with a closet 160.

Bedroom 154, has a doorway 162 into corridor 156 and is provided with a closet 164 at its forward end.

Immediately forward of bedroom 154, at the front corner of the housing structure is a bathroom 166 for unit U2. The bathroom has a bathtub 168, a toilet 170, and a sink 172. Bathroom 166 has a doorway 174 which opens into a corridor 176 into a laundry area 178. Laundry area 178 is provided with a washing machine 180, a dryer 182, and a linen closet 184.

Recreation room 146, master bedroom 152, and bedroom 154 are provided with windows 186, 188, and 190 respectively, in boundary walls 60 and 16.

FIG. 4 shows the upper floor level of the housing structure 10 converted to a single family home by removal of the fabricated wall panels 88, 110, 108 from the demising wall. Upon the removal of wall panel 88 from wall 24, kitchens 82 and 84 are in effect combined into a double sized kitchen 186; if appropriate the enlarged kitchen can be re-arranged as a kitchen and bar (not shown). One of the stoves 90 or 92 can be removed and replaced with a counter or a dishwasher or other appliance. One of the refrigerators 94 or 96 can be replaced with a freezer.

Removal of either or both of wall panels 108, 110 also effectively expands the living room and/or dining areas to sizes appropriate for a single family home. An internal partition 190, having an opening 192, may optionally be installed to separate the dining area 76 from the remainder of room 64, to create a dining room and den for the single family home. The entrance 15 functions as a side door and the forward portion of corridor 80 as a mudroom for the single family home. The doors 140 and 141 on the lower level (FIG. 3) are unlocked to provide free access between the lower levels of the two units.

FIGS. 5 to 8 show the prefabricated wall panel 108 (FIG. 2) installed in the demising wall 24, although these views are to be taken as representative of the construction and installation of all of the removable panels referred to above. Panel 108 is retained in wall 24 by casings 194 which are similar to a normal door casing and which are applied over the junction between panel 108 and wall 24 at both sides of the wall. Metal strips 198 cover the junction between the panel and the wall as a firebreak. The casings 194 are fastened to panel 108 only by wood screws 196, and merely overlie marginal portions of wall 24 around the opening therein. The screws 196 at the side of panel 108 which is in unit U2 are concealed in countersunk and filled holes in casing 194 while the screws at the other side of the panel (in unit U1) are removable.

Figure 6:
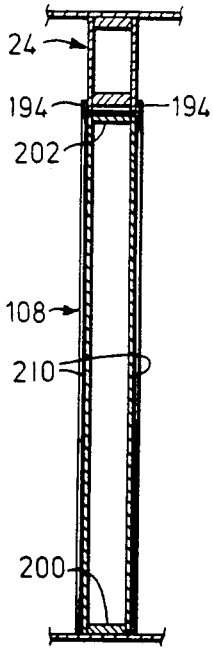
FIG. 6 is a vertical sectional view taken along line 6—6 in FIG. 5.
Figure 7:
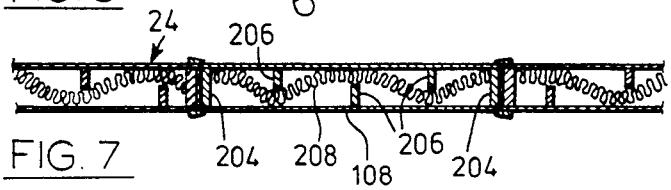
FIG. 7 is a horizontal section view taken along line 7—7 in FIG. 5; and, FIG. 8 is an enlarged view of part of FIG. 7.
Figure 8:
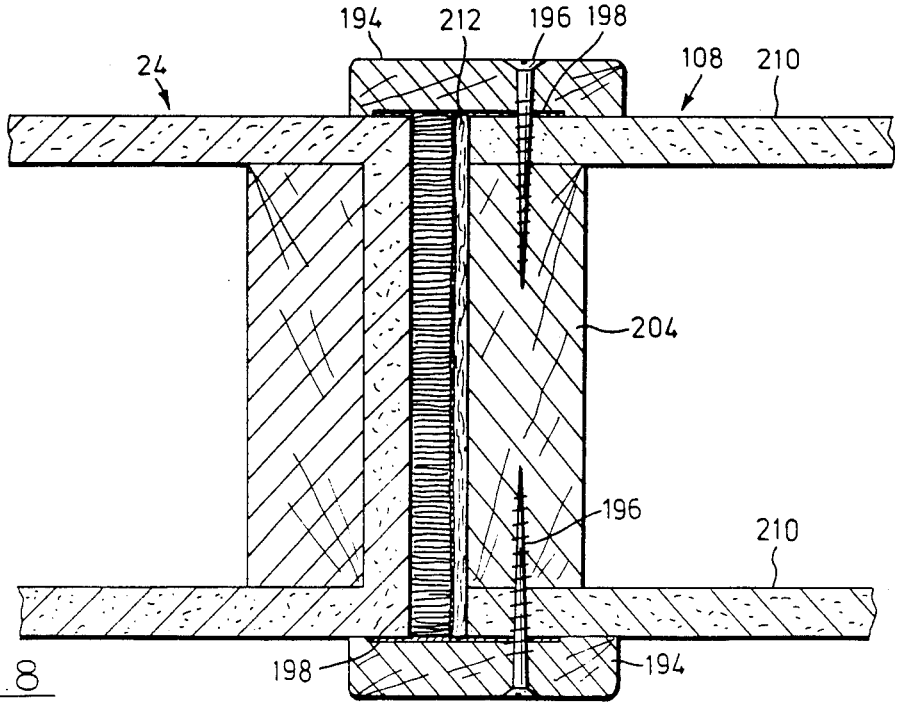

As shown in FIGS. 6 and 7, panel 108 comprises a frame made up of a base member 200, a top member 202 and two parallel jambs 204 (FIG. 7) at the sides of the panel. In this embodiment these frame members are 2×6 studs. The frame further comprises a plurality of 2×4 studs 206 extending vertically between the members 200 and 202 and the panel is completed by sheets of firecoat drywall 210 secured to the frame by screws. The studs 206 are spaced one foot apart, and extend alternately inwardly from the respective drywall sheets 210. Two inch fibreglass batt insulation 208 is woven between vertical studs 206 and packed to ensure total coverage of the voids between and around studs 206. All corners of wall 24 are taped and made good with gypsum plaster (not shown). As shown most clearly in FIG. 8, a strip of carpeting 212 is provided around the peripheral edge of panel 108 to substantially fill the space between the panel and the wall 24, for purposes of sound-proofing. The offset studs 206 and insulation 208 also contribute to sound insulation.

When the housing structure is constructed, the demising wall 24 is built with openings to receive the wall panels 88, 108, 110 and the floors, carpeting, drywalling etc. is completed before the wall panels are installed. The panels are then inserted into the openings and secured by casings of the form described above. The casings hold the panel tight to the wall. As indicated above and shown in FIG. 8 casings are provided at both sides of the demising wall so that the panel is held from both sides. To remove any of the panels, it is merely necessary to remove the casing 194 from one side of the panel; in this embodiment the screws holding the casing in unit U1 are accessible. The panel can then be pushed out of the opening in wall 24 into unit U2. No work is required to make good the wall 24 as the opening is in a fully finished condition before the panel is installed and installation of the panel does not damage the wall. It would of course be possible to remove and replace the same wall panel many times as the needs of the building change (provided of course the wall panel is carefully stored when not in use).

To summarize, the housing structure as shown in the drawings can be initially arranged as either a two family home or a single family home simply by virtue by the presence or absence of the removable panels 88, 108 and 110. Conversion of the structure between different configurations can readily be achieved by installing or removing the wall panels as the case may be, as described above.

The external appearance of the housing structure is that of a raised bungalow with a two-car garage 128 in the basement or lower level. The entrance 14 to living unit U1 is at the front of the structure, and the entrance 15 to unit U2 is at the side, making the structure always appear to be a single family home (as opposed to a semidetached or a duplex structure). No external or structural changes or changes in the plumbing or other mechanical systems are required for conversion between a two family home and a single family home.

It will of course be appreciated that the preceding description relates to a preferred embodiment of the invention only and that many modifications are possible within the broad scope of the invention. For example, while in the illustrated embodiment, the removable wall panels are shown both between the kitchens of the living units and between the living and dining areas, this is not essential within the broad scope of the invention. The illustrated embodiment has the advantage that the whole of the living space on the ground floor in effect "expands" when the panels are removed; however, in the minimum case, the demising wall need be provided with a section which can be opened between the kitchens only. Access between the two living units would then be exclusively by way of the kitchens. Where a second floor level is provided, it is not essential (although preferred) to provide for access between the living units on that level also.

The removable wall panel or panels need not be of the form disclosed. In fact, within the broad scope of the invention, it is merely necessary that the demising wall be capable of being opened between the living areas of the two units. This could be achieved, for example, by simply providing a section of non-load bearing wall between the drywall sheets normally provided on opposite sides of a demising wall. Conversion would then be somewhat more difficult in that it would be necessary to knock out a section of the wall and make good the remainder of the wall and while this would not be as convenient as providing a removable wall panel as disclosed, the wall could be designed to minimize disruption caused by removal of the section.

We claim:

1. A housing structure convertible between a single family home and a two family home, the structure defining two living units, each of which has a separate entrance and is capable of accommodating a family living separately from a family in the other unit, said living units including respective living areas which are disposed side by side and separated by a demising wall, said living areas including respective kitchens disposed in contiguous relationship on opposite sides of said wall and the wall including at least one section between the kitchens which is closed when the structure is to serve as a two family home but which can be opened to permit access between the two kitchens when the structure is to serve as a single family home, the kitchens and wall section being designed to permit the kitchens to combine into a single enlarged kitchen and provide access between the two living units when the section is open; wherein the structure has at least two levels and is vertically divided by said demising wall so that said living units are both disposed on two levels, stairs being provided for permitting access between different levels of the same unit; and wherein the housing structure has the external appearance of a conventional house having a front door providing an entrance to one of said living units and a side door providing access to the other of said units.

2. A structure as claimed in claim 1, wherein said living units each includes a living room and a dining area disposed in said living area of the unit, said living rooms and dining areas of the respective units being disposed in substantially contiguous relationship, and wherein said demising wall includes further sections between said living room and said dining areas which are closed when the structure is to serve as a two family home but which can be opened to effectively provide an enlarged living room and an enlarged dining room area when the structure is to serve as a single family home.

3. A structure as claimed in claim 1 or 2, wherein the or each said wall section which can be opened comprises a wall panel removably retained in a corresponding opening in said demising wall, said opening extending through the wall and being adapted to permit access between said living areas when the panel has been removed.

4. A structure as claimed in claim 1, which is a two level structure, wherein each unit includes at least one bedroom, the bedrooms of the respective units being disposed on different levels.

5. A structure as claimed in claim 1, wherein said living areas of the respective units are disposed on the upper level of the structure and wherein the demising wall is provided on the lower level with an additional said section which is closed when a structure is to serve as a two family home but which can be opened to permit access between the two units when the structure is to serve as a single family home.

6. A housing structure convertible between a single family home and a two family home, the structure defining two living units, each of which has a separate entrance and is capable of accommodating a family living separately from a family in the other unit, said living units including respective living areas which are disposed side by side and separated by a demising wall, said living areas including respective kitchens disposed in contiguous relationship on opposite sides of said wall and the wall including at least one section between the kitchens which is closed when the structure is to serve as a two family home but which can be opened to permit acces between the two kitchens when the structure is to serve as a single family home, the kitchens and wall section being designed to permit the kitchens to combine into a single enlarged kitchen and provide access between the two living units when the section is open, said housing structure having the external appearance of a conventional house having a front door providing an entrance to one of said living units and a side door providing access to the other of said units.

* * * * *